US008758078B2

(12) United States Patent
Damarin

(10) Patent No.: US 8,758,078 B2
(45) Date of Patent: Jun. 24, 2014

(54) FLEXIBLE TOY CAR RACING TRACK

(76) Inventor: Gary Damarin, West Jordan, UT (US)

( * ) Notice: Subject to any disclaimer, the term of this patent is extended or adjusted under 35 U.S.C. 154(b) by 337 days.

(21) Appl. No.: 13/296,772

(22) Filed: Nov. 15, 2011

(65) Prior Publication Data

US 2012/0171925 A1 Jul. 5, 2012

Related U.S. Application Data

(60) Provisional application No. 61/429,241, filed on Jan. 3, 2011.

(51) Int. Cl.
*A63H 18/00* (2006.01)
*E01B 23/00* (2006.01)

(52) U.S. Cl.
USPC ..... 446/444; 446/445; 238/10 A

(58) Field of Classification Search
USPC ..... 446/28, 75–77, 169, 429, 430, 431, 446/444, 445; 238/10 A, 10 E
See application file for complete search history.

(56) References Cited

U.S. PATENT DOCUMENTS

| | | | | |
|---|---|---|---|---|
| 1,662,162 | A | 3/1928 | Nestor | |
| 2,120,251 | A | 6/1938 | Johnson | |
| 2,574,067 | A | 11/1951 | Seidman | |
| 2,853,301 | A | 9/1958 | Glass | |
| 3,502,332 | A | 3/1970 | Wolf | |
| 3,658,333 | A | 4/1972 | Carcel | |
| 3,735,923 | A * | 5/1973 | Brigham et al. | 238/10 E |
| 3,986,717 | A | 10/1976 | Kirby et al. | |
| 4,077,628 | A | 3/1978 | Hebert | |
| 4,108,437 | A | 8/1978 | DeAnda et al. | |
| 4,217,727 | A * | 8/1980 | Fetty et al. | 104/120 |
| 4,291,878 | A | 9/1981 | Nagel et al. | |
| 4,558,867 | A * | 12/1985 | Hippely | 273/412 |
| 4,605,229 | A | 8/1986 | McKay | |
| 4,715,602 | A | 12/1987 | May et al. | |
| 5,074,465 | A * | 12/1991 | Nepper | 238/10 E |
| 7,241,223 | B1 | 7/2007 | Caudill | |
| 7,651,398 | B2 | 1/2010 | Ostendorff et al. | |
| 7,770,811 | B2 * | 8/2010 | Belding | 238/10 R |
| 2006/0196961 | A1 | 9/2006 | Belding | |
| 2008/0035748 | A1 * | 2/2008 | Belding | 238/10 E |
| 2008/0248716 | A1 * | 10/2008 | Shackelford et al. | 446/444 |

* cited by examiner

*Primary Examiner* — Nini Legesse
(74) *Attorney, Agent, or Firm* — Thorpe North & Western LLP

(57) ABSTRACT

A flexible toy car racing track comprises two paths to receive and guide toy cars along a length of the track. A raised portion forms a boundary between the two paths. A recessed portion is formed on a bottom of the track and coincides with the raised portion. The raised portion engages the recessed portion when the flexible track is rolled up in a compact storage configuration. The engagement between the raised portion and the recessed portion restricts relative lateral movement between the raised portion and the recessed portion to maintain the track in the rolled up storage configuration.

20 Claims, 4 Drawing Sheets

FLEXIBLE TOY CAR RACING TRACK

The present application claims the benefit of U.S. Provisional Patent Application No. 61/429,241, filed on Jan. 3, 2011, the entirety of which is incorporated herein by reference.

BACKGROUND

Racing toy cars on racing tracks can provide entertainment for people of all ages. One common form of racing uses a non-powered toy car, wherein the toy car is either propelled or released to coast down a track. Toy car racing tracks can vary in length and complexity. In use, the length of a toy car track may be limited by the available space for using the track. For storage of a toy car track, however, storage size of the track may be a concern and can limit the length of track that one is able to enjoy. Some toy car tracks are segmented to allow the track to be dismantled for storage. A segmented track, however, can result in lengthy set-up and/or take-down procedures, and also has unwanted discontinuities where the track is joined together which slightly impairs the smooth movement of a car down or along a track.

DETAILED DESCRIPTION

Figure 1A:
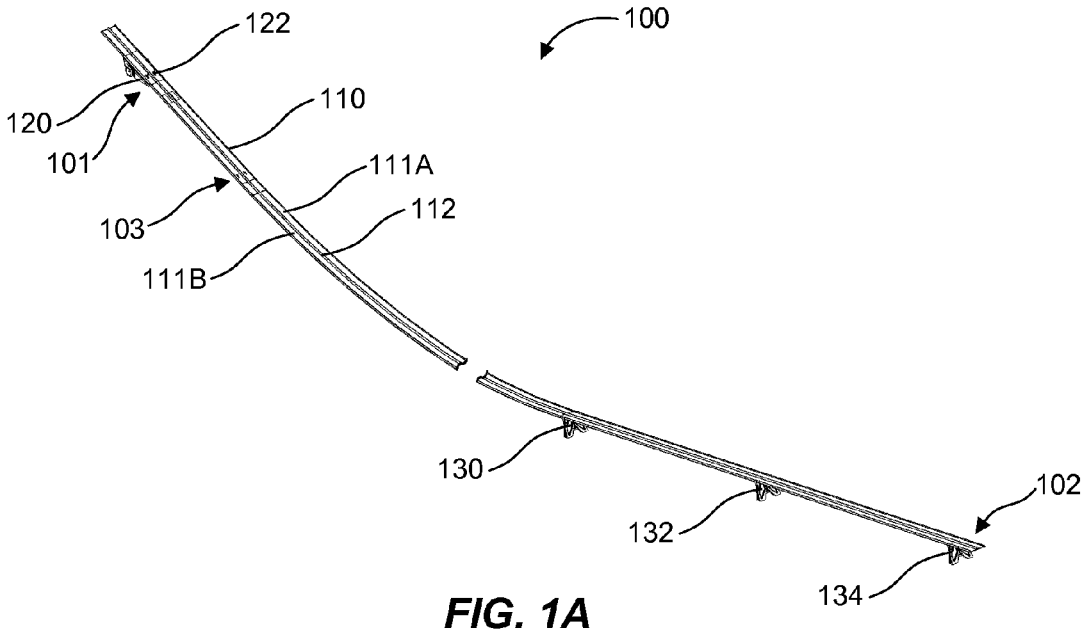
FIG. 1A is a perspective view of a toy car racing system in accordance with an example of the present disclosure.

Reference will now be made to certain examples, and specific language will be used herein to describe the same. Examples discussed herein set forth a flexible toy car racing track that can enable compact storage of the track in a rolled up configuration. In particular examples, the flexible toy car racing track can include features that restrict lateral movement of adjacent portions of the track when in the rolled up storage configuration.

Specifically, a flexible toy car racing track can comprise two paths to receive and guide toy cars along a length of the track. The flexible toy car racing track can also comprise a raised portion forming a boundary between the two paths. Additionally, the flexible toy car racing track can comprise a recessed portion formed on a bottom of the track and coinciding with the raised portion. The raised portion can engage the recessed portion when the flexible track is rolled up in a compact storage configuration. The engagement between the raised portion and the recessed portion restricts relative lateral movement between the raised portion and the recessed portion to maintain the track in the rolled up storage configuration.

In another example, a toy car racing system can comprise a flexible toy car racing track. The flexible toy car racing track can include two paths to receive and guide toy cars along a length of the track. The flexible toy car racing track can also include a raised portion forming a boundary between the two paths. Additionally, the flexible toy car racing track can include a recessed portion formed on a bottom of the track and coinciding with the raised portion. The raised portion can engage the recessed portion when the flexible track is rolled up in a compact storage configuration. The engagement between the raised portion and the recessed portion can restrict relative lateral movement between the raised portion and the recessed portion to maintain the track in the rolled up storage configuration. In addition, the toy car racing system can comprise a starting assembly coupled to the racing track to position a toy car for a start and to allow movement of the toy car from the starting assembly along one of the two paths toward a finish end of the track.

Furthermore, a method for storing a toy car racing track in accordance with the principles herein can comprise obtaining a flexible toy car racing track having two paths to receive and guide toy cars along a length of the track, a raised portion forming a boundary between the two paths, and a recessed portion formed on a bottom of the track and coinciding with the raised portion. The method can also comprise rolling up the flexible racing track into a compact storage configuration such that the raised portion engages the recessed portion of the flexible track. Additionally, the method can comprise restricting relative lateral movement between the raised portion and the recessed portion with the engagement between the raised portion and the recessed portion to maintain the track in the rolled up storage configuration.

With these general examples set forth above, it is noted in the present disclosure that when describing the flexible toy car racing track described herein, or their related systems or methods, each of these descriptions are considered applicable to the other, whether or not they are explicitly discussed in the context of that embodiment. For example, in discussing the flexible toy car racing track per se, the system and method embodiments are also included in such discussions, and vice versa.

Furthermore, various modifications and combinations can be derived from the present disclosure and illustrations, and as such, the following figures should not be considered limiting. It is noted that reference numerals in various FIGS. will be shown in some cases that are not specifically discussed in that particular figure. Thus, discussion of any specific reference numeral in a given figure is applicable to the same reference numeral of related figures shown herein.

It is also noted that in the embodiments described herein, complete engagement of the raised portion into the recessed portion can also be present when the track is in its rolled up configuration, i.e. where the raised portion firmly contacts the recessed portion on both of its respective lateral sides. In this configuration, when rolled for storage, the raised portion and the recessed portion become interlocked and prevented from substantial lateral movement.

Illustrated in FIG. 1A is a toy car racing system 100. The racing system 100 can include a toy car racing track 110 and a starting assembly 120. The starting assembly can be configured to position a toy car for a start and to allow movement of the toy car from the starting assembly along the track toward a finish end 102 of the track. In one aspect, a toy car contemplated for use with the system can be configured to "coast" or "roll" along the track under the influence of gravity.

Thus, the starting assembly can be coupled to the track at a starting location 101 and located at a vertical distance above at least an adjacent portion of the track to allow the toy car to proceed under gravity induced movement down the track from the starting assembly. In one specific example, the length of the track can be 1:64 of a standard quarter mile race track, so as to simulate a 1:64 scale quarter mile drag race. Thus, a height and slope of the track should be set up to allow 1:64 scale cars to roll the entire length of the 1:64 scale quarter mile race track.

Support towers 130, 132, 134 can be coupled to the track to elevate the track. The support towers can be of the same or various heights to achieve a desired elevation at a given location of the track. For example, the support towers can be progressively lower in height from the starting location to the finish location, such that support tower 130 is taller than support tower 132, which is taller than support tower 134. In one aspect, a support tower can elevate the track for gravity induced movement of the toy car on the track. Support tracks can also be arranged with a taller support member following a shorter support member to provide a "rise" in the track.

The starting assembly 120 can include a release mechanism 122 that inhibits movement of the toy car down the track prior to the start of a race and then releases the toy car to begin the race. The release mechanism can include an arm that is movable between a pre-start position and a race position. The pre-start position can comprise the arm extending from the track to prevent movement of the toy car along the path and the race position can comprise the arm retracted toward the track to allow the car to proceed along the path. The starting location of the track can therefore include openings to allow the release mechanism to extend through the track to prevent movement of the toy car. The release mechanism is discussed in more detail below.

The track can include multiple starting locations, such as starting location 101 and starting location 103, to vary a racing distance for the toy car. Thus, the starting assembly can be movable along the track to provide a range of available starting positions for the toy car. Optionally, the racing distance can be varied by designating a different finish location on the track.

The track 110 can have paths 111A, 111B to receive and guide toy cars along a length of the track. The track can include a raised portion 112 forming a boundary between the paths. Although only two paths are shown in the figure, the track can include two or more paths. Also, as mentioned, the track can be configured to accommodate toy cars of any size, with 1:64 scale or 1:32 scale being typical. Additionally, the track can be of any suitable length. For example, the track can be sized to provide a scaled quarter mile race for the toy cars. To achieve a desired length, the track can comprise a single unitary construction of the desired length or the track can comprise multiple track segments fitted end-to-end and totaling the desired length. Because a 1:64 scale quarter mile track is quite long, i.e. 20.625 feet, the rolled storage configuration shown in FIG. 1B provides a compact storage solution while retaining a desirable smooth track along its entire length thereof.

Figure 1B:
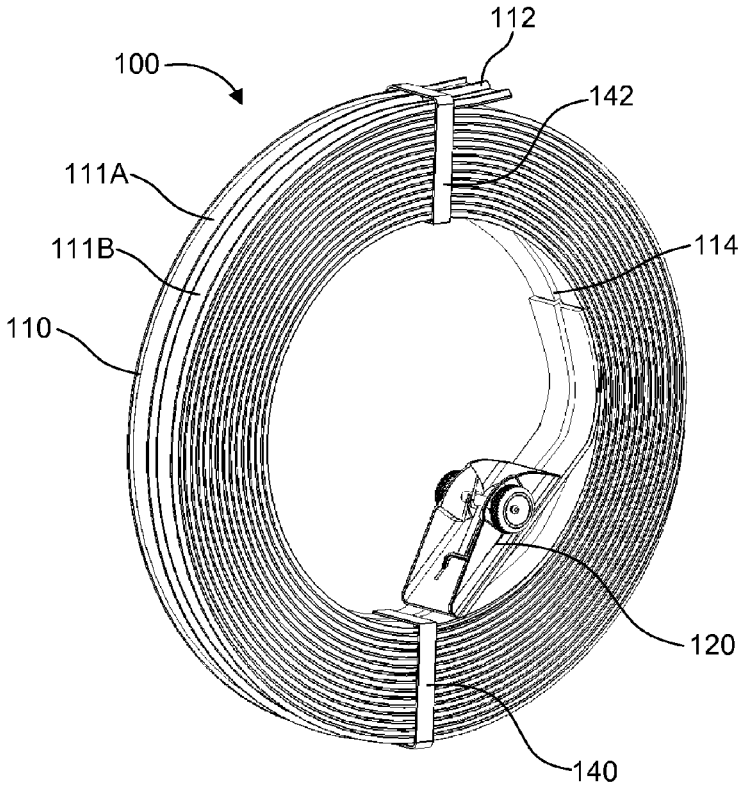
FIG. 1B is the toy car racing system of FIG. 1A in a rolled up storage configuration.

Turning now specifically to FIG. 1B is the toy car racing system 100 in a rolled up compact storage configuration. Due to the length of the track 110, which can result in numerous rolled layers of track, it may be difficult to maintain the track in the rolled up storage configuration. For example, one rolled layer may slide laterally relative to an adjacent rolled layer. To combat such lateral movement of the rolled track, a recessed portion 114 can be formed on a bottom of the track. The recessed portion can coincide with the raised portion 112, such that the raised portion engages the recessed portion when in the rolled up compact storage configuration. The engagement between the raised portion and the recessed portion can restrict relative lateral movement between the raised portion and the recessed portion to maintain the track in the rolled up storage configuration. In one specific embodiment, complete engagement can be present, as shown, where the raised portion contacts the recessed portion on both of its lateral sides, forming an interlocked configuration allowing for little to no lateral movement from layer to layer of rolled track. One benefit of the this type of engagement between the raised portion and the recessed portion is that an entire length of track can be rolled up and stored conveniently and efficiently. If the track comprises only a single uninterrupted length of track, this can improve the practicality of using such a track due to the benefits of a compact rolled storage configuration. Such storage capabilities are also advantageous for a track having multiple segments, because the track can be effectively stored without the need to break the track down into its component track segments for storage.

Optionally, a fastening mechanism, such as fastening mechanisms 140, 142, can be used to secure the track 110 when in the rolled up storage configuration. In one example, however, a single fastening mechanism may be all that is used to hold the track in the rolled up storage configuration. In either case, whether a single fastening mechanism or multiple fastening mechanisms are used, the mechanism can include a strap, band, tie, clip, bracket, or any other suitable fastening mechanism for the rolled up track. In one aspect, the fastening mechanism can include an elastic strap with a hook and loop fastener to wrap around and secure a portion of the rolled up track. As shown in the figure, the starting assembly 120 can be located at an inner portion of the rolled up storage configuration, although this need not be the case.

Figure 2A:
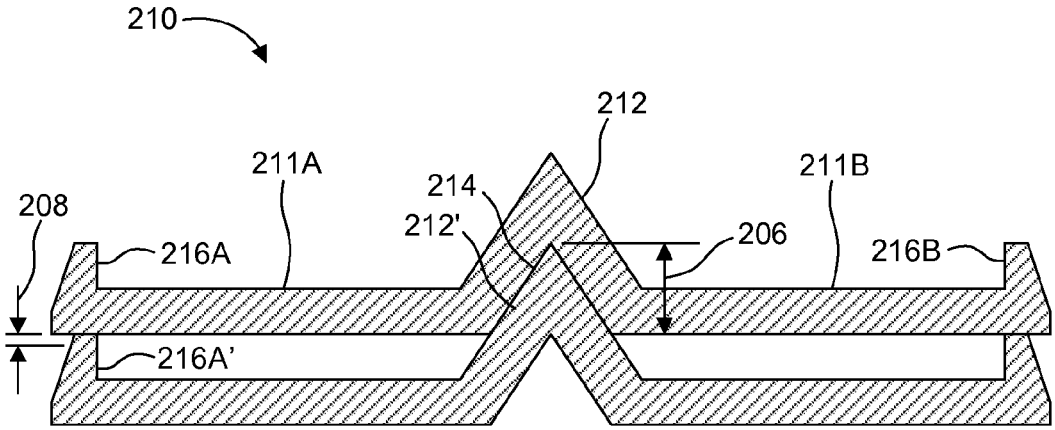
FIG. 2A is a cross-sectional view of two adjacent layers of a toy car track in a rolled up storage configuration in accordance with an example of the present disclosure.

Illustrated in FIG. 2A is a cross-sectional view of two adjacent layers of a toy car track 210 in a rolled up storage configuration. As shown in the figure, a raised portion 212 can form a boundary between two paths 211A, 211B. A recessed portion 214 can be form on a bottom of the track and can coincide with the raised portion. When the flexible track is rolled up in a compact storage configuration, the raised portion 212' can be configured to engage the recessed portion 214 of an adjacent layer. The engagement between the raised portion 212' and the recessed portion 214 can be configured to restrict or even prevent relative lateral movement between the raised portion and the recessed portion to maintain the track in the rolled up storage configuration. In one aspect, the raised portion and the recessed portion can be configured to interlock with one another, such that the raised portion and the recessed portion can be in lateral contact with one another when the track is in the rolled up storage configuration. For example, at least one of the raised portion and the recessed portion can comprise a V-shaped configuration to form an interlocking engagement between the raised portion and the recessed portion. Additionally, the raised portion and the recessed portion can be configured to overlap with one another by a length 206 sufficient to allow the lateral contact between the raised portion and the recessed portion to be effective in restricting relative lateral movement between the raised portion and the recessed portion. Although a V-shaped configuration is shown, it should be recognized that any other overlapping and interlocking engagement configuration can be employed. The present disclosure is therefore not to be limited to the V-shaped configuration shown.

FIG. 2A also illustrates an example of an outer wall 216A, 216B configuration for the toy car track 210. An outer wall can form an outer boundary for each of the two paths 211A, 211 B opposite the raised portion 212. When in the rolled up storage configuration, outer walls 216A, 216A' of adjacent layers can be separated by a distance 208. In other words, the outer walls can be configured to have clearance when in the rolled up storage configuration. In this case, the interface and engagement between the raised portion 212' and the recessed portion 214 can restrict relative lateral movement between the adjacent layers to maintain the track in the rolled up storage configuration without any assistance from the outer walls.

Figure 2B:
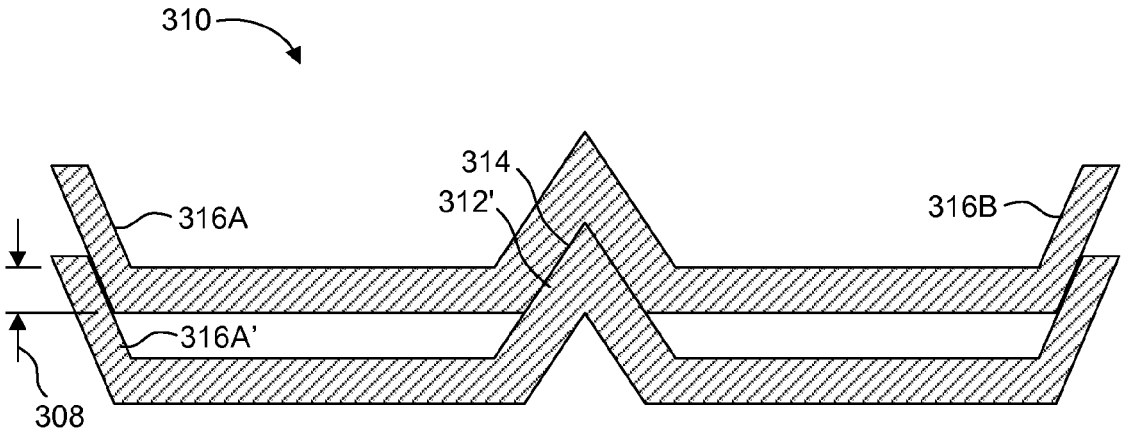
FIG. 2B is a cross-sectional view of two adjacent layers of a toy car track in a rolled up storage configuration in accordance with another example of the present disclosure.

FIG. 2B illustrates another example of an outer wall 316A, 316B configuration for a toy car track 310. When in the rolled up storage configuration, outer walls 316A, 316A' of adjacent layers can overlap by a distance 308. In other words, the outer walls of adjacent layers can be configured to have a lateral interface with one another when in the rolled up storage configuration. In this case, the outer walls can assist the engagement between the raised portion 312' and the recessed portion 314 of adjacent layers in restricting relative lateral movement between the adjacent layers and in maintaining the track in the rolled up storage configuration. The outer walls on each side of the examples illustrated in FIGS. 2A and 2B are shown as being similarly configured, with both sides having either a clearance or an overlap. However, it should be recognized that the outer walls on opposite sides need not match one another, as one wall can be configured to overlap and another can be configured to have clearance when in the rolled up storage configuration.

Figure 3A:
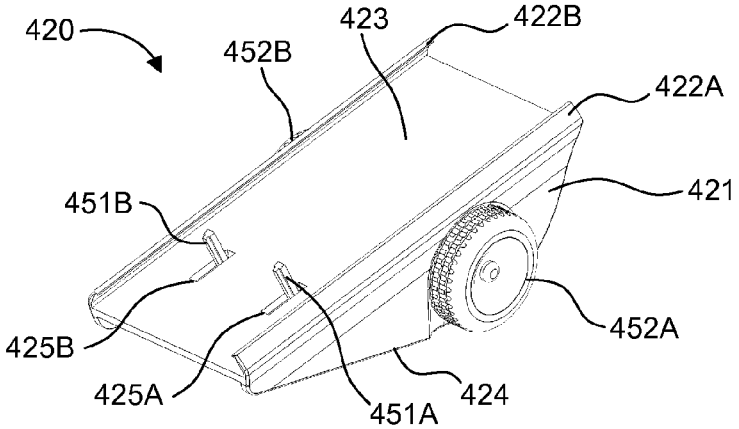
FIG. 3A is a perspective view of a starting assembly of a toy car racing system in accordance with an example of the present disclosure.

Referring to FIG. 3A, illustrated is a starting assembly 420 in accordance with an example of the present disclosure. The starting assembly can include a housing 421 that can be configured to couple with a toy car racing track as disclosed herein. For example, the housing can include flanges 422A, 422B and a track support surface 423 on an upper portion of the housing. The flanges can define outer edges of the track support surface and can extend away from the track support surface. To couple the starting assembly and the track, the flanges can capture outer walls of the track and maintain a bottom side of the track in contact with the track support surface.

A bottom 424 of the housing 421 can be configured to interface with a supporting surface (not shown) for the starting assembly 420. For example, the housing can be placed on an edge of a table or a step to provide a vertical distance between the starting assembly and an adjacent portion of the track. The bottom of the housing can include a friction enhancing feature to reduce slippage or movement of the starting assembly on the support surface. A friction enhancing feature can include a high friction material, such as rubber, and/or protrusions to engage the support surface.

Figure 3B:
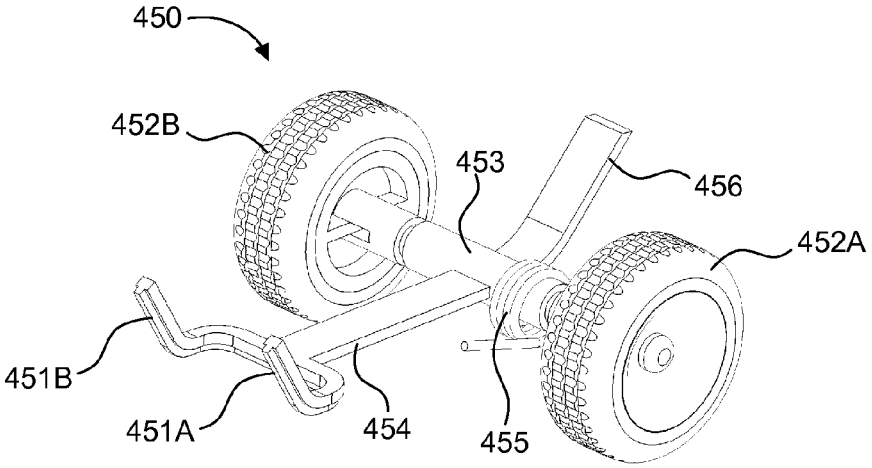
FIG. 3B illustrates components of the starting assembly hidden from view in FIG. 3A.

With reference to FIG. 3B, and continuing reference to FIG. 3A, the housing 421 can also be configured to support and facilitate operation of a release mechanism 450 of the starting assembly 420. For example, the housing can include openings 425A, 425B to allow release mechanism arms 451A, 451B to extend through the housing and the track to prevent movement of a toy car down the track. Additionally, the housing can be configured to support a user interface 452A, 452B to control the release mechanism.

With particular reference to FIG. 3B, the release mechanism 450 can include a movable arm, such as arms 451A, 451B. The arm can be used to maintain a toy car at a starting position and to release the toy car for movement down the track. In other words, the arm can be movable between a pre-start position and a race position. In the pre-start position, the arm can extend from the track, such as through an opening in the track, to prevent movement of the car along the track. In the race position, the arm can be retracted toward the track to allow the car to proceed along the track.

In one aspect, the arms 451A, 451B can be rotatable between the pre-start position and the race position. For example, the arms can be coupled to a pivot member 453 by an extension member 454. Rotation of the pivot member can therefore cause rotation of the arms between the pre-start and race positions. The user interface 452A, 452B can be coupled to the pivot member to allow a user to cause rotation of the pivot member. The user interface can comprise a knob, lever, handle, switch, button, or other form of interface to allow the user to cause rotation of the pivot member. As shown in the figure, a user interface can be styled as an automotive component, such as a tire. This can enhance the visual appeal of a toy car racing system. Although a user interface is shown on each side of the release mechanism, it should be recognized that a user interface can be located on only a single side of the release mechanism.

A spring 455 can be disposed about the pivot member 453 to bias the arms 451A, 451B in a desired position. For example, the spring can bias the arms in the pre-start position, such that force is required to overcome the biasing effect of the spring in order to move the arms to the race position to allow the toy cars to proceed down the track. Additionally, an arm stop 456 can be coupled to the pivot member to limit a range of motion of the arms. For example, the arm stop can be configured to contact the housing 421 when the arms are in the race position. Such contact can limit the movement of the arms and provide a user with tactile feedback that the arms are properly positioned to allow the toy car to proceed down the track. The user can then release the user interface and the spring can cause the arms to move back to the pre-start position. The arm stop can also prevent over-rotation of the pivot member, thereby protecting the spring from damage.

Figure 4:
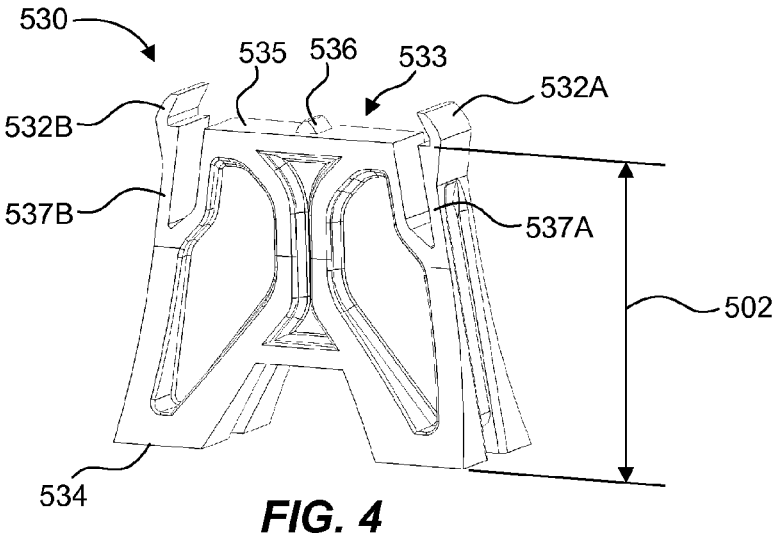
FIG. 4 is a perspective view of a support tower of a toy car racing system in accordance with an example of the present disclosure.

Illustrated in FIG. 4 is a support tower 530 in accordance with an example of the present disclosure. The support tower can be used to elevate the track above a support surface by a length 502. In one aspect, the support member can be configured to couple with the track. For example, the support member can include flanges 532A, 532B and a track support region 533 on an upper portion of the support member. The flanges can define outer boundaries of the track support region and can extend away from the track support region to capture outer walls of the track and maintain a bottom side of the track in contact with a track support surface 535 of the track support region. The track support region can optionally include a protrusion 536 to interface with a recessed portion of the track to provide additional coupling support for the support member.

The flanges 532A, 532B can each extend from a pivot arm 537A, 537B biased to a secure the track between the flanges. Movement of the pivot arms can cause the flanges to move outward to allow outer walls of the track to fit between the flanges. Thus, by moving the pivot arms outward, the support member can be attached to or removed from the track. This feature allows the support member to be coupled to the track at any given location without the necessity of sliding the support member from an end of the track to the desired location of the track.

Additionally, a bottom 534 of the support member 530 can be configured to interface with a supporting surface for the support member. The bottom of the support member can include a friction enhancing feature to reduce slippage or movement of the support member on the support surface. A friction enhancing feature can include a high friction material, such as rubber, and/or protrusions to engage the support surface.

Figure 5:
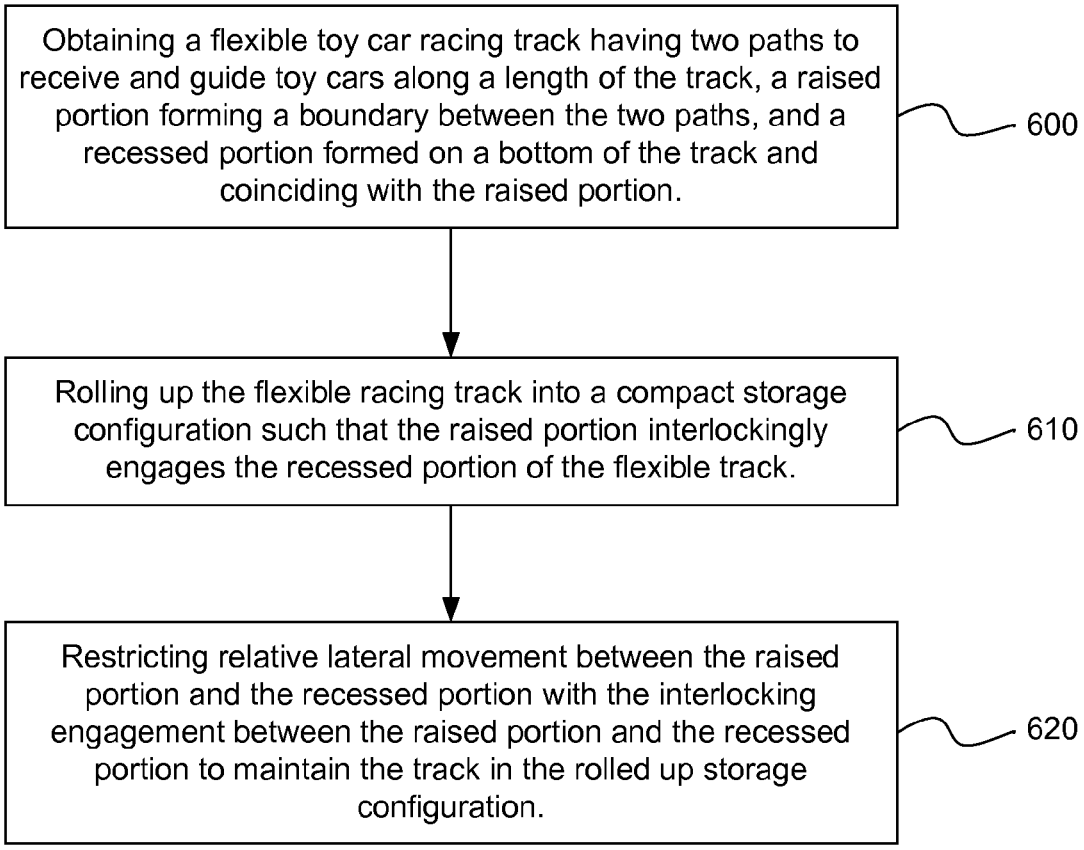
FIG. 5 is a flow diagram of a method in accordance with an example of the present disclosure.

In a related embodiment, and to reiterate to some degree, a method for storing a toy car racing track in accordance with the principles herein is shown in FIG. 5. The method comprises obtaining a flexible toy car racing track having two paths to receive and guide toy cars along a length of the track, a raised portion forming a boundary between the two paths, and a recessed portion formed on a bottom of the track and coinciding with the raised portion 600. The method further comprises rolling up the flexible racing track into a compact storage configuration such that the raised portion engages the recessed portion of the flexible track 610. Additionally, the method comprises restricting relative lateral movement between the raised portion and the recessed portion with the engagement between the raised portion and the recessed portion to maintain the track in the rolled up storage configuration 620. It is noted that no specific order is required in this method, though generally in one embodiment, these method steps can be carried out sequentially.

In one aspect, the method further comprises obtaining a starting assembly for the track to position a toy car for a start and to allow movement of the toy car from the starting assembly along one of the two paths toward a finish end of the track. In another aspect, the method further comprises coupling the starting assembly to the track. In an additional aspect, the method comprises rolling up the starting assembly inside the track such that the starting assembly is disposed in a center area of the track in the storage configuration.

While the foregoing examples are illustrative of the principles and concepts discussed herein, it will be apparent to those of ordinary skill in the art that numerous modifications in form, usage and details of implementation can be made without the exercise of inventive faculty, and without departing from those principles and concepts. Accordingly, it is not intended that the principles and concepts be limited, except as by the claims set forth below.

What is claimed is:

1. A flexible toy car racing track, comprising:

two paths to receive and guide toy cars along a length of the track;

a raised portion forming a boundary between the two paths; and a recessed portion formed on a bottom of the track and coinciding with the raised portion, wherein the raised portion engages the recessed portion when the flexible track is rolled up in a compact storage configuration, and wherein engagement between the raised portion and the recessed portion restricts relative lateral movement between the raised portion and the recessed portion to maintain the track in the rolled up storage configuration.

2. The flexible toy car racing track of claim 1, wherein a cross-section of the raised portion and recessed portion each comprises a V-shaped configuration.

3. The flexible toy car racing track of claim 1, wherein engagement between the raised portion and the recessed portion is complete engagement with firm contact provided between both lateral exterior sides of the raised portion and both lateral interior sides of the recessed portion.

4. The flexible toy car racing track of claim 1, further comprising an outer wall forming an outer boundary for each of the two paths opposite the raised portion.

5. The flexible toy car racing track of claim 1, wherein the length of the track is sized to provide a scaled quarter mile race for a toy car.

6. The flexible toy car racing track of claim 1, wherein the flexible toy car racing track is a continuous single piece that is not segmented along its racing surface.

7. A toy car racing system, comprising:

a flexible toy car racing track having:

two paths to receive and guide toy cars along a length of the track, a raised portion forming a boundary between the two paths, and a recessed portion formed on a bottom of the track and coinciding with the raised portion, wherein the raised portion engages the recessed portion when the flexible track is rolled up in a compact storage configuration, and wherein engagement between the raised portion and the recessed portion restricts relative lateral movement between the raised portion and the recessed portion to maintain the track in the rolled up storage configuration; and a starting assembly coupled to the racing track to position a toy car for a start and to allow movement of the toy car from the starting assembly along one of the two paths toward a finish end of the track.

8. The toy car racing system of claim 7, wherein the starting assembly allows the toy car to proceed under gravity induced movement.

9. The toy car racing system of claim 8, further comprising a support tower coupled to the racing track to elevate the track for gravity induced movement of a toy car on the track.

10. The toy car racing system of claim 7, wherein the starting assembly is movable along the track to provide a range of available starting positions for the toy car.

11. The toy car racing system of claim 7, wherein the starting assembly comprises a release mechanism having an arm that is movable between a pre-start position and a race position, wherein the pre-start position comprises the arm extending from the track to prevent movement of the car along the path and the race position comprises the arm retracted toward the track to allow the car to proceed along the path.

12. The toy car racing system of claim 11, wherein the arm is rotatable between the pre-start position and the race position.

13. The toy car racing system of claim 11, wherein the arm is biased to the pre-start position.

14. The toy car racing system of claim 11, wherein the pre-start position further comprises extending the arm through an opening in the track.

15. The toy car racing system of claim 11, wherein the starting assembly further comprises a user interface to control the release mechanism.

16. The toy car racing system of claim 7, wherein the length of the track is sized to provide a scaled quarter mile race for the toy car.

17. The toy car racing system of claim 7, further comprising a fastening mechanism to secure the track when in the rolled up storage configuration.

18. A method for storing a toy car racing track, comprising:

obtaining a flexible toy car racing track having two paths to receive and guide toy cars along a length of the track, a raised portion forming a boundary between the two paths, and a recessed portion formed on a bottom of the track and coinciding with the raised portion;

rolling up the flexible racing track into a compact storage configuration such that the raised portion engages the recessed portion of the flexible track; and restricting relative lateral movement between the raised portion and the recessed portion with the engagement between the raised portion and the recessed portion to maintain the track in the rolled up storage configuration.

19. The method of claim 18, further comprising:

obtaining a starting assembly for the track to position a toy car for a start and to allow movement of the toy car from the starting assembly along one of the two paths toward a finish end of the track; and coupling the starting assembly to the track.

20. The method of claim 19, further comprising rolling up the starting assembly inside the track such that the starting assembly is disposed in a center area of the track in the storage configuration.

* * * * *